US010738775B2

(12) United States Patent
Boos et al.

(10) Patent No.: US 10,738,775 B2
(45) Date of Patent: Aug. 11, 2020

(54) METHOD AND CONTROL DEVICE FOR OPERATING A RECIPROCATING PISTON PUMP

(71) Applicant: Robert Bosch GmbH, Stuttgart (DE)

(72) Inventors: Edna Boos, Eberdingen (DE); Roland Waschler, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 168 days.

(21) Appl. No.: 15/870,660

(22) Filed: Jan. 12, 2018

(65) Prior Publication Data

US 2018/0202427 A1 Jul. 19, 2018

(30) Foreign Application Priority Data

Jan. 13, 2017 (DE) ..... 10 2017 200 537

(51) Int. Cl.

| | |
|---|---|
| ***F04B 43/02*** | (2006.01) |
| ***F04B 49/08*** | (2006.01) |
| ***F04B 13/00*** | (2006.01) |
| ***F04B 43/04*** | (2006.01) |
| ***F04B 49/06*** | (2006.01) |
| ***F04B 17/03*** | (2006.01) |
| ***F04B 49/00*** | (2006.01) |
| ***F04B 49/14*** | (2006.01) |
| ***F04B 45/04*** | (2006.01) |

(52) U.S. Cl.

CPC ..... *F04B 43/02* (2013.01); *F04B 13/00* (2013.01); *F04B 17/03* (2013.01); *F04B 43/04* (2013.01); *F04B 49/002* (2013.01); *F04B 49/06* (2013.01); *F04B 49/08* (2013.01); *F04B 49/14* (2013.01); *F04B 45/04* (2013.01); *F04B 2205/06* (2013.01)

(58) Field of Classification Search

CPC ..... F04B 17/044; F04B 43/02; F04B 49/002; F04B 49/04; F04B 49/06; F04B 49/08; F04B 49/14; F04B 17/04

See application file for complete search history.

(56) References Cited

U.S. PATENT DOCUMENTS

| | | | | |
|---|---|---|---|---|
| 2006/0007628 | A1* | 1/2006 | Rembold | F02D 41/20 361/160 |
| 2009/0118954 | A1* | 5/2009 | Wu | B60W 10/08 701/60 |
| 2014/0227107 | A1* | 8/2014 | Bauer | F04B 43/04 417/44.2 |

FOREIGN PATENT DOCUMENTS

| | | |
|---|---|---|
| DE | 102008042987 | 4/2010 |
| DE | 102012009729 | 11/2013 |

* cited by examiner

*Primary Examiner* — Philip E Stimpert

(74) *Attorney, Agent, or Firm* — Michael Best & Friedrich LLP

(57) ABSTRACT

A method for actuating a pump having a reciprocating piston or a diaphragm for pressure generation in a hydraulic system, the reciprocating piston or the diaphragm being moved by way of an actuator which is driven by a magnetic field of a magnet coil, and a system pressure in the hydraulic system being determined.

18 Claims, 2 Drawing Sheets

METHOD AND CONTROL DEVICE FOR OPERATING A RECIPROCATING PISTON PUMP

BACKGROUND OF THE INVENTION

The invention relates to a method for actuating a pump having a reciprocating piston or a diaphragm for pressure generation in a hydraulic system, the reciprocating piston or the diaphragm being moved by way of an actuator which is driven by a magnetic field of a magnet coil, and a system pressure in the hydraulic system being determined.

Furthermore, the invention relates to a control device for actuating a pump having a reciprocating piston or a diaphragm for pressure generation in a hydraulic system, an actuator which is driven by a magnetic field of a magnet coil being provided for moving the reciprocating piston or the diaphragm, and a pressure sensor or an evaluation of a current flow through the magnet coil being provided to determine a system pressure in the hydraulic system.

In hydraulic systems without a return line, the pressure is usually generated by means of a reciprocating piston pump or a diaphragm pump. If required, a desired liquid quantity is removed via a metering device. A magnetically driven actuator for moving the piston or the diaphragm for the delivery stroke is provided in the pump. A spring is provided for the return of the piston or the diaphragm during a suction stroke. Setting of a desired setpoint pressure range can take place by means of a pilot control operation or in a closed control loop. Quantity control valves or pressure regulating valves or metering devices are typically used in order to realize the control loop. If the magnet coil which drives the magnetically driven actuator is actuated, the actuator performs a full stroke and the pump delivers a liquid quantity which is predefined by way of the magnitude of a delivery space. In order to return the actuator, either the actuating signal of the magnet coil is switched off and the magnetic field is dissipated via a freewheeling diode ("freewheel") or an extinguishing diode or an ohmic resistance is additionally provided for an accelerated dissipation of the magnetic field ("rapid extinguishing") across the magnet coil.

The switch-off by way of freewheeling has the advantage in comparison with the rapid extinguishing that the current through the magnet coil is dissipated more slowly and the electric loading and heat loss of the control unit are reduced. Since lower current gradients occur here, the electromagnetic compatibility (EMC) is more favorable. The noise emission of the pump is lower on account of the lower speed of the actuator during the return and the reduced speed during contact with the end position of the actuator. However, said slower suction stroke reduces the possible pump frequency and therefore the maximum possible delivery volume per unit time.

A higher pump frequency and therefore a higher quantity flow can be realized with a switch-off by way of rapid extinguishing. In this operating mode, however, the control unit is loaded by way of higher temperatures, and the noise emission of the pump is higher as a result of the higher contact speed of the actuator with the end stop.

Document DE 10 2008 042 987 A1 describes a metering apparatus for introducing liquids into an outlet space. The metering apparatus comprises a nozzle which opens into the outlet space and, furthermore, a metering unit having a metering valve. The metering valve comprises a valve stem which is guided in the valve body of the metering unit with the configuration of an intermediate space. The valve stem comprises at least one opening which makes the discharge of liquid into the intermediate space possible, the intermediate space being delimited by a flexible wall. Via the metering unit, the reducing agent can be injected into the outlet space via a pressure-controlled nozzle. Although DE 10 2008 042 987 A1 describes the technical environment, it does not disclose any regulating strategies as proposed by the present document.

DE 10 2012 009 729 A1 has disclosed a pressure delivery flow regulator for adjusting an adjusting unit of an adjustable hydraulic displacement machine, switching valves for actuating the adjusting unit being provided. According to claim 7, the switching valves of the adjusting unit can be actuated by way of an electronic control unit in a manner which is dependent on a pressure, in particular in a pressure line, and/or a displacement travel of the piston of the actuating cylinder. According to claim 8, the control unit can actuate the switching valves by way of a three-point control operation, in a manner which is dependent on the pressure. The three-point control operation is described in FIG. 2 and in paragraph [0044]. Here, the three-point control operation does not act by way of a single actuator which performs inward, outward and holding phases. Rather, the adjusting system overall, consisting of three actuators and the adjusting mechanism of the displacement machine, exhibits said behavior.

SUMMARY OF THE INVENTION

It is an object of the invention to provide a method which makes a desired regulating accuracy of the system pressure possible in a metering system having a reciprocating piston pump or a diaphragm pump without a regulating valve. Furthermore, it is an object of the invention to reduce the power loss and the noise emission of the metering system.

Furthermore, it is an object of the invention to provide a control device which is suitable for carrying out the method.

The object of the invention which relates to the method is achieved by virtue of the fact that the magnet coil is operated with a switch-off by way of freewheeling or a switch-off by way of rapid extinguishing in a manner which is dependent on the system pressure and/or at least one temporally filtered system pressure. As a result of the appropriate use of switch-off operations by way of freewheeling, the noise emission and the heat generation of the pump can be reduced in comparison with a continuous operation by way of rapid extinguishing. In the case of an increased quantity flow, a switch-off by way of rapid extinguishing is used, with the result that the required delivery performance is available. The system pressure can be determined by means of a pressure sensor or from the flow of the electric current through the magnet coil.

It is provided in one design variant of the method with low noise emission that the magnet coil is operated with the switch-off by way of freewheeling if a first pressure curve lies below a first pressure threshold, and the first pressure curve or a second pressure curve lies above a second pressure threshold, the second pressure threshold being lower than the first pressure threshold. Here, the first pressure curve can correspond to the system pressure which is determined by way of a pressure sensor, or can be derived from the system pressure by way of a first low pass filtering operation. The second pressure curve can likewise be derived by way of a second low pass filtering operation from the system pressure or the first pressure curve. It has proved advantageous to carry out the second low pass filtering operation with a longer time constant than the first low pass filtering operation.

It is provided in a further design variant of the method with low noise emission that the magnet coil is operated with the switch-off by way of freewheeling if the first pressure curve lies below the first pressure threshold, and the first pressure curve or the second pressure curve lies below the second pressure threshold and above a third pressure threshold, and the directly preceding switch-off took place by way of rapid extinguishing, and with the third pressure threshold lying below the second pressure threshold.

It is provided in one design variant of the method with an increased delivery volume that the magnet coil is operated with the switch-off by way of rapid extinguishing if the first pressure curve lies below the first pressure threshold, and the first pressure curve or the second pressure curve lies below the third pressure threshold.

It is provided in a further design variant of the method with an increased delivery volume that the magnet coil is operated with the switch-off by way of rapid extinguishing if the first pressure curve lies below the first pressure threshold, and the second pressure curve lies below the second pressure threshold and above the third pressure threshold, and the directly preceding switch-off took place by way of freewheeling.

It is provided in one design variant of the method that the decision about a switch-off of the magnet coil by way of freewheeling or by way of rapid extinguishing takes place solely or additionally on the basis of an evaluation of a time gradient of the first and/or the second pressure curve. Here, a pump cycle is actuated if the first pressure curve undershoots the first pressure threshold.

The object of the invention which relates to the apparatus is achieved by virtue of the fact that a program sequence or a circuit for carrying out a method according to one of the preceding design variants is provided in the control device.

BRIEF DESCRIPTION OF THE DRAWINGS

In the following text, the invention will be described in greater detail by way of one exemplary embodiment which is shown in the figures, in which.

DETAILED DESCRIPTION

Figure 1:
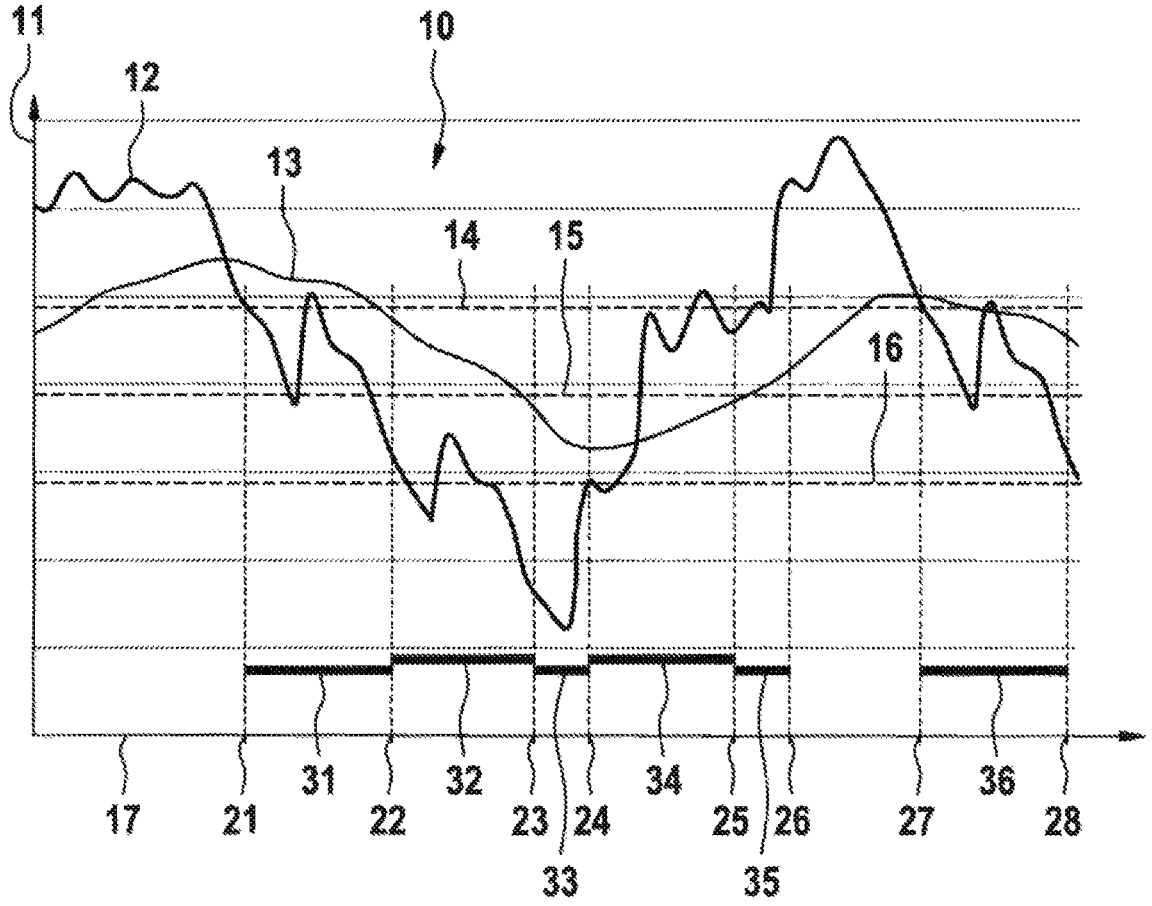
FIG. 1 shows a diagram of pressure curves in a hydraulic system.
Figure 2:
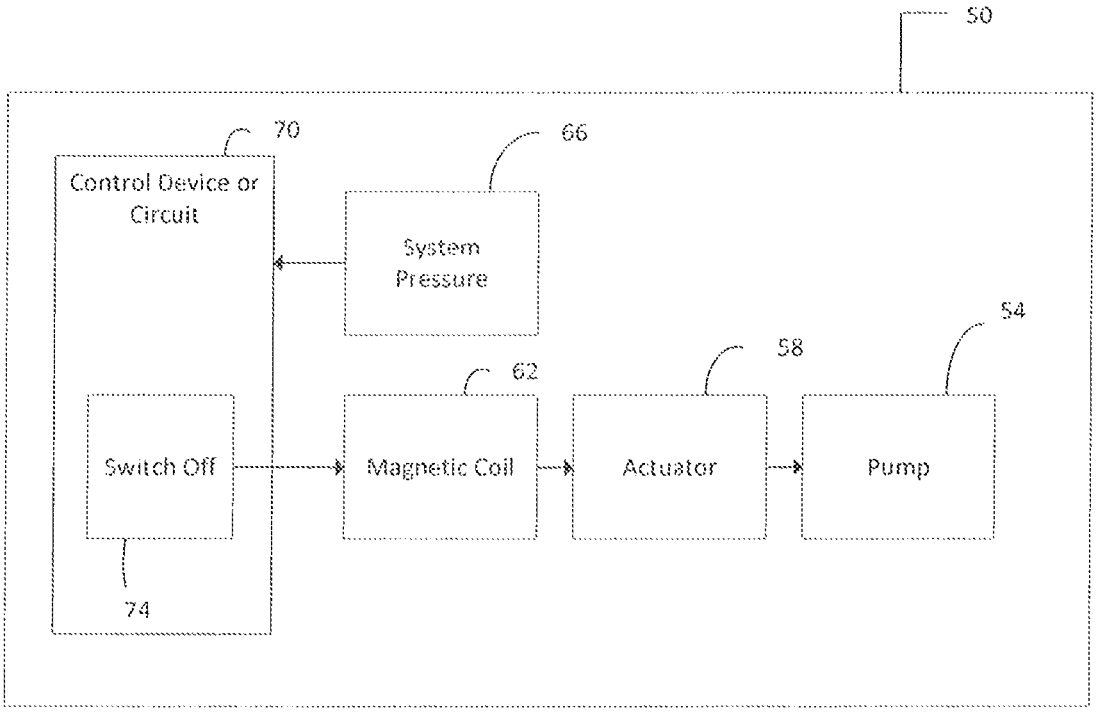
FIG. 2 shows a block diagram of a hydraulic system for a metering device.

FIG. 1 shows a pressure diagram 10 with a pressure axis 11 and a time axis 17. In the pressure diagram 10, a first pressure curve 12 and a second pressure curve 13 are plotted which represent the time gradient of a system pressure in a hydraulic system having a reciprocating piston pump or a diaphragm pump or a variable which can be derived therefrom. The hydraulic system 50 shown in FIG. 2 includes a pump 54 driven by way of a magnetic actuator 58 which is moved by a magnetic field of a magnet coil 62. The reciprocating piston pump or diaphragm pump 54 can be used by way of example for generating a system pressure 66 in a metering device for a urea/water solution ("AdBlue") in a nitrogen removal system in the exhaust gas channel of an internal combustion engine. In the exemplary embodiment, the first pressure curve 12 is generated from the system pressure by way of low pass filtering by a control device or circuit 70. The second pressure curve 13 is obtained from the system pressure or from the first pressure curve 12 by way of a low pass filtering operation with a greater time constant than in the case of the generation of the first pressure curve 12. It is provided according to the invention that the first pressure curve 12 and the second pressure curve 13 are compared with a first pressure threshold 14, a second pressure threshold 15 which lies below the latter, and a third pressure threshold 16 which lies below the second pressure threshold 15. A derivation is made by the control device 70 from the comparisons and further logical links as to whether the magnet coil 62 is operated in a following pump cycle with a switch-off 74 of the control device or circuit 70 by way of freewheeling or a switch-off by way of rapid extinguishing.

For a pump cycle, the magnet coil 62 is loaded with electric voltage for a predefined duration. In the case of a switch-off by way of freewheeling, the voltage source is disconnected from the magnet coil, and the magnet force is dissipated via a freewheeling diode which is arranged in parallel to the magnet coil. In the case of a switch-off by way of rapid extinguishing, the dissipation of the magnetic force is assisted and accelerated by an extinguishing diode (Zener diode) which is connected to the magnet coil or an ohmic resistance. The switch-off by way of rapid extinguishing has the advantage that the pump cycle is shortened overall and therefore more pump cycles can proceed per unit time. As a result, the delivery quantity of the pump per unit time can be increased. Secondly, the higher speed of the magnetic actuator at the end stop leads to increased noise emission. The heat loss in the system is increased and leads to a temperature increase of the pump and the associated actuating means. The switch-off by way of freewheeling has the advantage that the current through the magnet coil is dissipated more slowly. The electric loading of the actuating means is therefore prevented, and the electromagnetic compatibility (EMC) of the system is improved. Furthermore, the noise emission is reduced by way of the reduced speed of the magnetic actuator at the end stop. This variant is suitable if the longer pump cycle and the delivery performance which is reduced as a result are sufficient in the respective operating case.

It is provided according to the invention to make a selection between the switch-off by way of freewheeling and the switch-off by way of rapid extinguishing in a manner which is dependent on the required delivery performance under the current operating conditions. A removal of liquid from the system results in a pressure drop. The system pressure is therefore used to make a decision about the type of switch-off. Here, as in the present example, the system pressure can be filtered for evaluation by way of one or more low pass filters.

The following rules apply to the decision about the type of switch-off for the exemplary embodiment which is shown here:

1. If the first pressure curve 12 exceeds the first pressure threshold 14, the pump is not actuated.
2. An actuation of the pump and a switch-off by way of freewheeling takes place if the first pressure curve 12 undershoots the first pressure threshold 14, and the second pressure curve 13 exceeds the second pressure threshold 15, or the second pressure curve 13 undershoots the second pressure threshold 15, exceeds the third pressure threshold 16, and the last switch-off used rapid extinguishing.
3. An actuation of the pump and a switch-off by way of rapid extinguishing takes place if the first pressure curve 12 undershoots the first pressure threshold 14, and the second pressure curve 13 undershoots the third pressure threshold 16, or the second pressure curve 13 undershoots the second pressure threshold 15, exceeds the third pressure threshold 16, and the last switch-off took place by way of freewheeling.

In addition to the first and second pressure curves 12, 13, the switch-off operations which are derived therefrom for the pump cycles are also shown in the pressure diagram 10. At the left-hand start of the pressure diagram 10, the first pressure curve 12 lies above the first pressure threshold 14, and no pump cycle takes place. At the first time 21, the first pressure curve 12 undershoots the first pressure threshold 14, and a first pump cycle 31 is started. Since the second pressure curve 13 exceeds the second pressure threshold 15, the first pump cycle 31 is controlled with a switch-off by way of freewheeling, and lasts up to the second time 22. The first pressure curve 12 initially rises, but falls further overall on account of a further removal of liquid.

At the second time 22, the first pressure curve 12 lies below the first pressure threshold 14, with the result that a second pump cycle 32 is started immediately. Since the second pressure curve 13 exceeds the second pressure threshold 15, the second pump cycle 32 is controlled with a switch-off by way of freewheeling, and lasts up to the third time 23.

At the third time 23, the first pressure curve 12 lies below the first pressure threshold 14, with the result that a third pump cycle 33 is started immediately. Since the second pressure curve 13 undershoots the second pressure threshold 15, but exceeds the third pressure threshold 16, AND the preceding pump cycle was switched off by way of freewheeling, the third pump cycle 33 is controlled with a switch-off by way of rapid extinguishing, and lasts up to the fourth time 24.

At the fourth time 24, the first pressure curve 12 lies below the first pressure threshold 14, with the result that a fourth pump cycle 34 is started immediately. Since the second pressure curve 13 undershoots the second pressure threshold 15, but exceeds the third pressure threshold 16, AND the preceding pump cycle was switched off by way of rapid extinguishing, the fourth pump cycle 34 is controlled with a switch-off by way of freewheeling, and lasts up to the fifth time 25.

At the fifth time 25, the first pressure curve 12 lies below the first pressure threshold 14, with the result that a fifth pump cycle 35 is started immediately. Since the second pressure curve 13 undershoots the second pressure threshold 15, but exceeds the third pressure threshold 16, AND the preceding pump cycle was switched off by way of freewheeling, the fifth pump cycle 35 is controlled with a switch-off by way of rapid extinguishing, and lasts up to the sixth time 26. At the sixth time 26, the first pressure curve 12 lies above the first pressure threshold 14, with the result that no further pump cycle is initially actuated.

At the seventh time 27, the first pressure curve 12 undershoots the first pressure threshold 14, with the result that a sixth pump cycle 36 is started. Since the second pressure curve 13 lies above the second pressure threshold 15, the sixth pump cycle 36 is controlled with a switch-off by way of freewheeling, and lasts up to the eighth time 28.

The invention claimed is:

1. A method for actuating a pump having a reciprocating piston or a diaphragm for pressure generation in a hydraulic system, the reciprocating piston or the diaphragm being moved by way of an actuator which is driven by a magnetic field of a magnet coil, the method comprising:

determining a system pressure in the hydraulic system; and operating the magnet coil by selecting between a switch-off by way of freewheeling or a switch-off by way of rapid extinguishing, the selection being dependent on a first pressure curve corresponding to the system pressure and/or to at least one temporally filtered system pressure.

2. The method according to claim 1, characterized in that the magnet coil is operated with the switch-off by way of freewheeling when the first pressure curve (12) corresponding to the system pressure lies below a first pressure threshold (14), and the first pressure curve (12) or a second pressure curve (13) derived from the temporally filtered system pressure by a low pass filtering operation lies above a second pressure threshold (15), the second pressure threshold (15) being lower than the first pressure threshold (14).

3. The method according to claim 1, characterized in that the magnet coil is operated with the switch-off by way of freewheeling when the first pressure curve (12) lies below a first pressure threshold (14), and the first pressure curve (12) or a second pressure curve (13) derived from the temporally filtered system pressure by a low pass filtering operation lies below a second pressure threshold (15) and above a third pressure threshold (16), and an immediately preceding switch-off took place by way of rapid extinguishing, and with the third pressure threshold (16) lying below the second pressure threshold (15).

4. The method according to claim 1, characterized in that the magnet coil is operated with the switch-off by way of rapid extinguishing when the first pressure curve (12) lies below a first pressure threshold (14), and the first pressure curve (12) or a second pressure curve (13) derived from the temporally filtered system pressure by a low pass filtering operation lies below a third pressure threshold (16).

5. The method according to claim 1, characterized in that the magnet coil is operated with the switch-off by way of rapid extinguishing when the first pressure curve (12) lies below a first pressure threshold (14), and a second pressure curve (13) derived from the temporally filtered system pressure by a low pass filtering operation lies below a second pressure threshold (15) and above a third pressure threshold (16), and an immediately preceding switch-off took place by way of freewheeling.

6. A control device, the control device comprising a program sequence or a circuit for carrying out the method according to claim 1.

7. The method according to claim 1, wherein the pump is free from a regulating valve.

8. A method for actuating a pump having a reciprocating piston or a diaphragm for pressure generation in a hydraulic system, the reciprocating piston or the diaphragm being moved by way of an actuator which is driven by a magnetic field of a magnet coil, the method comprising:

determining a system pressure in the hydraulic system; and operating the magnet coil with a switch-off by way of freewheeling or a switch-off by way of rapid extinguishing in a manner which is dependent on the basis of an evaluation of a time gradient of a first and/or a second pressure curve.

9. The method according to claim 8, wherein the pump is free from a regulating valve.

10. A method for actuating a pump having a reciprocating piston or a diaphragm for pressure generation in a metering device of a urea/water solution in a nitrogen removal system, the reciprocating piston or the diaphragm being moved by way of an actuator which is driven by a magnetic field of a magnet coil, the method comprising:

determining a system pressure in the metering device; and operating the magnet coil by selecting between a switch-off by way of freewheeling or a switch-off by way of rapid extinguishing in a manner which is, the selection being dependent on a first pressure curve corresponding to the system pressure and/or at least one temporally filtered system pressure.

11. The method according to claim 10, wherein the magnet coil is operated with the switch-off by way of freewheeling when the first pressure curve (12) lies below a first pressure threshold (14), and the first pressure curve (12) or a second pressure curve (13) derived from the temporally filtered system pressure by a low pass filtering operation lies above a second pressure threshold (15), the second pressure threshold (15) being lower than the first pressure threshold (14).

12. The method according to claim 10, wherein the magnet coil is operated with the switch-off by way of freewheeling when the first pressure curve (12) lies below a first pressure threshold (14), and the first pressure curve (12) or a second pressure curve (13) derived from the temporally filtered system pressure by a low pass filtering operation lies below a second pressure threshold (15) and above a third pressure threshold (16), and an immediately preceding switch-off took place by way of rapid extinguishing, and with the third pressure threshold (16) lying below the second pressure threshold (15).

13. The method according to claim 10, wherein the magnet coil is operated with the switch-off by way of rapid extinguishing when the first pressure curve (12) lies below a first pressure threshold (14), and the first pressure curve (12) or a second pressure curve (13) derived from the temporally filtered system pressure by a low pass filtering operation lies below a third pressure threshold (16).

14. The method according to claim 10, wherein the magnet coil is operated with the switch-off by way of rapid extinguishing when the first pressure curve (12) lies below a first pressure threshold (14), and a second pressure curve (13) derived from the temporally filtered system pressure by a low pass filtering operation lies below a second pressure threshold (15) and above a third pressure threshold (16), and an immediately preceding switch-off took place by way of freewheeling.

15. The method according to claim 10, wherein a decision about a switch-off of the magnet coil by way of freewheeling or by way of rapid extinguishing takes place solely or additionally on the basis of an evaluation of a time gradient of the first pressure curve (12) and/or a second pressure curve (13) derived from the temporally filtered system pressure by a low pass filtering operation.

16. A control device, the control device comprising a program sequence or a circuit for carrying out the method according to claim 1.

17. The method according to claim 10, wherein the nitrogen removal system is provided for an exhaust gas channel of an internal combustion engine.

18. The method according to claim 10, wherein the pump is free from a regulating valve.

* * * * *